United States Patent [19]

Fowlie

[11] 4,066,171

[45] Jan. 3, 1978

[54] DESK STAND FOR HOLDING IN OPERATIVE POSITION POCKET CALCULATORS AND OTHER DESK-TOP ARTICLES

[76] Inventor: William J. C. Fowlie, 2129 SE. Ladd Ave., Portland, Oreg. 97214

[21] Appl. No.: 658,708

[22] Filed: Feb. 17, 1976

[51] Int. Cl.[2] ..... A47F 7/00

[52] U.S. Cl. ..... 211/69.1; 211/13; 248/459

[58] Field of Search ..... 211/69.1, 73, 72, 13, 211/126, 11, 50, 69.5; 224/48 R; 248/174, 459; 206/214, 215, 73, 561, 562, 563

[56] References Cited

U.S. PATENT DOCUMENTS

| | | | |
|---|---|---|---|
| 1,211,065 | 1/1917 | Brady | 206/73 |
| 1,727,011 | 9/1929 | Heileman | 206/73 |
| 1,831,712 | 11/1931 | Keenan | 211/69.5 |
| 1,974,814 | 9/1934 | Hall | 211/69.9 X |
| 2,444,096 | 6/1948 | Faust | 211/126 X |
| 3,166,194 | 1/1965 | Nichols | 211/69.9 X |
| 3,176,662 | 4/1965 | Williams | 211/69.5 |
| 3,198,339 | 8/1965 | Stolarz | 248/459 X |
| 3,203,552 | 8/1965 | Stolarz | 248/459 X |
| 3,379,316 | 4/1968 | Harrell | 211/73 |

*Primary Examiner*—Roy D. Frazier
*Assistant Examiner*—Robert W. Gibson, Jr.
*Attorney, Agent, or Firm*—Eugene D. Farley

[57] ABSTRACT

A desk stand for holding in operative position pocket calculators and other desk-top articles comprises a single sheet of stiff, structural material shaped to provide a bed for receiving the article, flanges to maintain the article on the bed, and at one end a support foot inclining the bed at a predetermined angle.

1 Claim, 2 Drawing Figures

DESK STAND FOR HOLDING IN OPERATIVE POSITION POCKET CALCULATORS AND OTHER DESK-TOP ARTICLES

BACKGROUND AND SUMMARY OF THE INVENTION

This invention pertains to stands for holding pocket calculators and like articles. It pertains particularly to stands for holding such articles on desk tops, and is described herein with particular reference to this application although no limitation thereby is intended since it is suitable also for holding such articles on other supporting surfaces such as counters, ledges, cabinets, decks, or machine tops.

Pocket calculators are difficult to use at a desk or similar location because they are small and when placed on the desk lie in a flat position in which they are not readily visible to a person seated at the desk. Also, they are light in weight and when used tend to slide around on the desk top, making it mandatory that the operator employ both hands when making a calculation, one to manipulate the keys and one to hold the calculator.

It accordingly is the general purpose of the present invention to provide a desk stand for holding pocket calculators and other desk top articles in an operative position wherein their keyboards are readily visible to the operator and in which they are secured against sliding movement during use, thereby leaving one hand free for writing or performing other functions necessary or ancillary to the operation of the calculator.

It is another important object of the present invention to provide a desk stand for holding pocket calculators which is versatile in that it may be used also for holding pocket radios, paper memorandum pads, packs of cards and, for use associated therewith, pencils, pens, or small tools.

Still another object of the present invention is the provision of a desk stand for holding pocket calculators and the like which may be fabricated simply and inexpensively from a single sheet of structural material and which additionally is sturdy, stable, durable, and attractive in appearance.

The desk stand fulfilling the foregoing purposes and objectives in its broad aspect comprises a sheet of stiff, structural material such as metal or plastic shaped along predetermined lines to provide a bed dimensioned to receive the article and a support foot comprising a reversely bent portion of the sheet dimensioned to space the rearward end of the bed from a supporting surface, thereby inclining the bed upwardly and rearwardly at a predetermined angle. Upright peripheral flanges surround the bed on three sides, enclosing it and in use retaining the articles thereon. Lateral extensions of the reversely bent portion, provided with aligned guide-and-socket holes, are positioned for receiving pencils, pens or like implements to be used in conjunction with the stand.

DETAILED DESCRIPTION OF A PREFERRED EMBODIMENT

Figure 1:
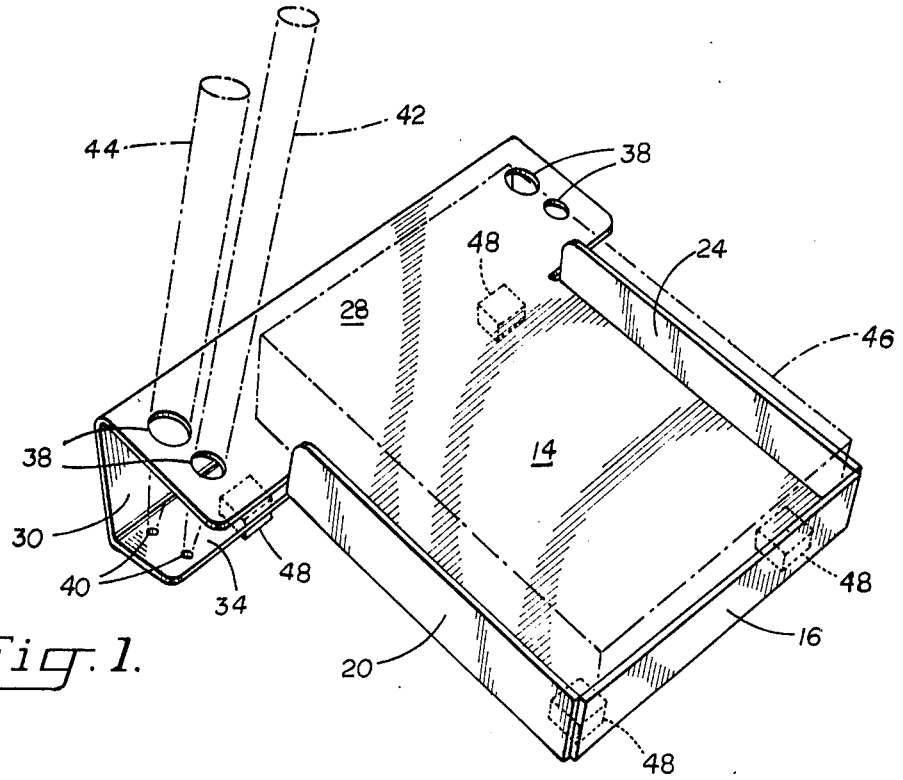
Figure 2:
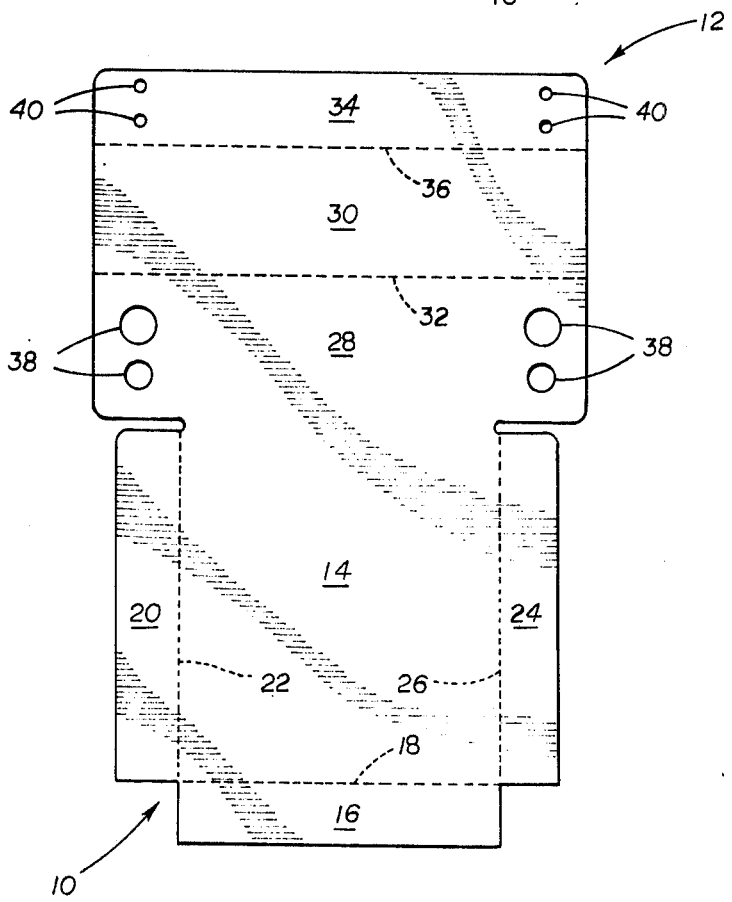

The foregoing and other objects and advantages of the present invention are accomplished by means of the embodiment described in the following specification with particular reference to the drawings wherein:

FIG. 1 is a perspective view of the hereindescribed desk stand in its completed condition, and FIG. 2 is a plan view of a blank employed for the manufacture of the stand.

The stand of my invention may be manufactured from any suitable sheet material which is stiff or rigid, and shapeable along predetermined forming lines. However, it also may be manufactured from materials which may be molded in a desired contour. Suitable structural materials thus comprise metal sheets, and plastic materials which are available in the form of sheets or which are moldable into sheet form.

The stand preferably is fabricated from a sheet of bendable structural material which may be die cut or otherwise formed into a bed or article holding portion at one end, and a foot support portion at the other end. In the drawings, the bed portion is indicated generally by the numeral 10, and the foot support portion by the numeral 12.

As shown in FIG. 2, the blank is so cut that the bed portion 10 includes a centrally located bed 14 dimensioned to contain the article to be held; a front end flange 16 defined by bend or fold line 18; a first side flange 20 defined by bend or fold line 22; and an opposite side flange 24 defined by bend or fold line 26.

The support foot portion 12 includes a substantially horizontal top segment 28 substantially coplanar with bed 14; a substantially vertical connecting segment 30, defined by bend or fold line 32; and a substantially horizontal bottom segment 34, defined by bend or fold line 36.

The lateral margins of foot segment 28 are provided with openings 38 while the lateral margins of foot segment 34 are provided with openings 40 of somewhat smaller diameter. In the completed condition of the stand, the two sets of openings are aligned with and spaced from each other. The enlarged openings 38 act as guides, while the restricted openings 40 serve as sockets so that in combination they comprise guide-and-socket retainers for pencils 42, pens 44, or other small implements.

The blank from which the stand is made is generally rectangular in outline. It is designed for fabrication into the finished product by bending flange flaps 16, 20, 24 upwardly along bend lines 18, 22, 24 respectively until they are substantially perpendicular to bed 14. They thus form retaining walls which hold the calculator 46 or other article in place.

Segment 30 of the foot support portion is bent downwardly along bend line 32 and segment 34 thereof is bent inwardly along bend line 36 thus establishing a reverse bend in which segment 28 is spaced vertically from segment 34 by an amount sufficient to establish a predetermined angle of inclination of bed 14. As noted above, establishing the reverse bend also brings into alignment openings 38 and 40 so that they may serve their proposed functions of acting as retainers for pens, pencils and the like.

Although the desk stand is useful in its above described condition, its utility may be augmented by providing anti-skid pads 48, one on each of the bottom corners of the stand. These may be square, circular, oval or elongated in contour and may be fabricated from natural or synthetic rubber, plastic, or other non-skid material.

In the use of the desk stand, it is placed on the desk, counter or other supporting surface in the aspect of FIG. 1. A pocket calculator 46 or other article to be held then may be placed in the indicated position wherein it is supported on bed 14 and retained by flanges 16, 20, 24. In its upwardly inclined position, its working face is readily available to an operator seated at the desk or counter. Also, since it is retained securely within the flanges and since the stand itself has a non-slip mounting, the calculator may be operated with one hand only, leaving the operator's other hand free for the performance of calculator-related activities.

Having thus described my invention in preferred embodiments, I claim:

1. A desk stand for holding in operative position pocket calculators and other desk top articles, the desk stand comprising a single sheet of stiff, structural material shaped and bent along predetermined lines to provide:

a. a bed dimensioned to receive the articles, b. upright peripheral flanges along the opposite sides and front end of the bed to retain the article thereon, and c. a support foot comprising a substantially vertical connecting section extending downwardly from the rear end of the bed and a substantially horizontal reversely bent bottom section extending forwardly from the bottom end of the vertical connecting section, the front edge of the bed and the bottom section of the support foot serving to engage a desk top for support of the desk stand thereon, said support foot thereby inclining the bed upwardly and rearwardly at a predetermined angle of inclination, d. the vertical and horizontal sections of the support foot and the overlying rearward portion of the bed being extended laterally beyond the plane of at least one of the side flanges, the lateral extension of the rearward portion of the bed and the horizontal bottom section of the support foot having at least one pair of aligned guide-and-socket openings positioned for receiving and retaining a pencil, pen, or like pointed object, the opening in the lateral extension of the bed being sufficiently large to receive the body of the pointed object and the opening in the horizontal section of the support foot forming a retaining socket for the pointed end of the object.

* * * * *